US006796038B2

(12) United States Patent
Humphries

(10) Patent No.: US 6,796,038 B2
(45) Date of Patent: Sep. 28, 2004

(54) RANGE ADJUSTABLE LASER SIGHT FOR ARCHERY

(75) Inventor: Lee Nelson Humphries, Hurricane, WV (US)

(73) Assignee: Lee N. Humphries, Hurricane, WV (US)

( * ) Notice: Subject to any disclaimer, the term of this patent is extended or adjusted under 35 U.S.C. 154(b) by 0 days.

(21) Appl. No.: 10/320,674

(22) Filed: Dec. 17, 2002

(65) Prior Publication Data

US 2004/0111899 A1 Jun. 17, 2004

(51) Int. Cl.[7] ..... F41G 1/467
(52) U.S. Cl. ..... 33/265; 33/DIG. 21
(58) Field of Search ..... 33/265, DIG. 21; 124/87

(56) References Cited

U.S. PATENT DOCUMENTS

| | | | | | |
|---|---|---|---|---|---|
| 4,638,565 | A | * | 1/1987 | Podany et al. | 33/265 |
| 4,939,863 | A | * | 7/1990 | Alexander et al. | 33/265 |
| 5,090,805 | A | * | 2/1992 | Stawarz | 124/87 |
| 5,201,122 | A | * | 4/1993 | Annunziata | 33/265 |
| 5,359,779 | A | * | 11/1994 | Polk et al. | 33/DIG. 21 |
| 5,419,050 | A | * | 5/1995 | Moore | 33/265 |
| 5,836,694 | A | * | 11/1998 | Nguyen | 33/DIG. 21 |
| 6,134,793 | A | * | 10/2000 | Sauers | 33/265 |
| 6,366,344 | B1 | * | 4/2002 | Lach | 33/265 |
| 6,526,666 | B1 | * | 3/2003 | Lastinger, Jr. | 33/265 |
| 2002/0088129 | A1 | * | 7/2002 | Huang et al. | 33/DIG. 21 |

* cited by examiner

*Primary Examiner*—G. Bradley Bennett
(74) *Attorney, Agent, or Firm*—Lee N. Humphries

(57) ABSTRACT

An environmentally sealed, self-contained, adjustable beam laser sight and stabilizer combination for use in archery. The laser sighting device of present invention is comprised of a single cylindrical compartment housing a power source, a laser module coupled to the power source and having a laser diode for emitting laser beams, a cam operated laser module elevating mechanism and an inner cylindrical body. The cylinder has a front face and a laser light exit formed at the center of the face and aligned with the laser diode. The outer cylinder is rotated axially about the inner body and acting on the laser positioning cam. The cam converts rotary motion into a linear position change acting on the face of the laser module producing an angular displacement about its pivoting axis resulting in a change of vertical divergence of the laser beam with respect to the bow. A user calibrated waterproof self-adhesive range scale is installed on the moving cylinder adjacent to a stationary base. The laser sight further incorporates an external adjuster module connected co-axially to the cylinder rear face by a pivoting screw. The adjusting module face contains an annular of set screws axially aligned with the cylinder's rear face. Alternate screw force applied at the rear cylinder face changes the horizontal and vertical angle of laser beam departure from the bow providing a true zero point adjustment. The adjuster module also attaches the laser sight/stabilizer to the bow's stabilizer bushing and provides vertical tracking alignment of the laser beam range adjustment with respect to the bow. Additionally the laser is activated by a hermetically sealed, magnetically controlled switch and adjustable finger ring magnet combination.

9 Claims, 8 Drawing Sheets

RANGE ADJUSTABLE LASER SIGHT FOR ARCHERY

FIELD OF THE INVENTION

The present invention concerns a light beam sight and stabilizer unit for use with archery bows and, more particularly, an improved range adjustable laser beam sight integrated into a stabilizer unit, providing a dual purpose device.

BACKGROUND AND PRIOR ART

Archers have long used many types of sights to aim the arrows point of impact. Lasers have been extensively used as a sighting aid in archery. U.S. Pat. No. 6,366,344 B1 to Lach and U.S. Pat. No. 5,419,050 to Moore are good examples. Both patents teach bow sights incorporating lasers. The laser is oriented to emit a light beam in the direction of the arrows flight from the bow. In both patents the laser is positioned above the arrow rest and the inclination of the laser can be adjusted by a cam arrangement. A change in inclination of the laser beam when aligned with a target results in a corresponding change of the arrow's trajectory thus compensating for target distance. The Lach and Moore patents are both attached to the bow is a similar manner and location. Both provide inclination adjustment in the plane of the bow but do not provide an adjustment for horizontal alignment of the light beam. Both the Lach and Moore patents provide for a fixed amount of vertical adjustment or "span" to compensate for target distance but neither provides for a vertical span offset or "zero" adjustment.

The Moore and Lach patents require a flat surface for attachment to a bow and require the archer to hold the bow perpendicular to the horizon for proper operation. No provisions are made to allow the archer to hold the bow other that perpendicular to the horizon.

Laser sights for use in archery are very effective and useful devices under certain shooting conditions. During periods of intense ambient light however, a laser is of little or no benefit. Under these conditions it is desirable to have an alternate sighting system. There are many such suitable sight offering on the market today. Most of these sights are designed to attach to a bow in the industry standardized configuration. This is problematic to the Moore and Lach patents. The Moore and Lach patents both attach to the bow in a similar manner making it difficult or impossible to use a conventional sighting system synchronously with their respective laser sight designs. The Moore and Lach patents interfering with the installation of a conventional sight and the archer's required line of sight in the use there of.

The ancient art of archery has evolved into a high tech sporting industry. Though the original fundamentals of an arrow in flight remain the same, the introduction of modem materials and designs have greatly improved the performance of the arrow and its flight. The invention of the compound bow design has greatly improved the archer's ability to launch an arrow. These technological advancements have improved the sport of archery while creating new design challenges and desires of even greater performance.

The modem compound bow is a complex machine designed to put an arrow into flight. These machines (bows) take advantage of multiple pulley and lever arrangements, the latest materials and manufacturing techniques to produce a state of the art weapon. These modem bows are common and manufactured by many companies. While these products vary from make and model, the industry has adopted some standards. One of these standards is the mounting configuration of conventional peep sights for pointing the arrow's flight to the desired target. Another standard is the inclusion of a means to attach a stabilizer to the bow to improve pointability, balance and absorb unwanted energy.

Today's archer is provided a wide range of products to improve performance. There is a variety of pin, electronic, telescopic and laser sights to choose from. All of which have advantages over the other as well as inherent strengths and weaknesses. No one type proves to perform best under all conditions. Ideally a combination of sight options would provide the best solution to all around shooting conditions. Unfortunately there is limited space provided for there installation. Additionally, there are numerous choices in stabilizers offered. The various designs address the issues of unwanted energy absorption, balance and improved pointing ability of the bow.

SUMMARY OF THE INVENTION

It is an objective of the present invention to provide a fully adjustable laser sighting aid and bow stabilizer combination for use in archery.

It is another objective of the present invention to provide a user calibrated laser sight which may be calibrated for any arrow trajectory.

It is yet another objective of the present invention to provide a rugged, self contained and waterproof laser sight.

It is yet another objective of the present invention to provide a laser sight that may be quickly and easily adjusted for changes of target distance.

It is yet another objective of the present invention to provide a laser sight that is turned on by a hermetically sealed magnet switch that is activated by an adjustable magnetic finger ring thus controlling illumination without applying unwanted force to the bow.

It is yet another objective of the present invention to provide a laser sight that is adjustable for a user defined "zero" point of arrow impact.

It is yet another objective of the present invention to provide a laser sight that is adjustable for vertical orientation with respect to the bow.

It is yet another objective of the present invention to provide a laser sight that is complementary to and may be used synchronously with other bow mounted sighting systems.

It is yet another objective of the present invention to provide a laser sight that may be quickly and easily installed on any bow designed for the incorporation of a standard stabilizer unit.

The objectives of the present invention can be accomplished by providing an environmentally sealed, self-contained, adjustable beam laser sight and stabilizer combination. The laser sighting device of present invention is comprised of a cylindrical compartment housing a power source, a laser module coupled to the power source and having a laser diode for emitting laser beams, a cam operated laser module elevating mechanism and an inner cylindrical body. The cylinder has a front face and a laser light exit formed substantially at the center of the face and aligned with the laser diode. An outer cylinder is rotated axially about the inner body and acting on the laser positioning cam. The cam converts rotary motion into a linear position change acting on the face of the laser module producing an angular displacement about its pivoting axis resulting in a change of vertical divergence of the laser beam with respect to the bow. A user calibrated, waterproof, and self-adhesive range scale is installed on the moving outer cylinder adjacent to a stationary base. Another label of same construction is installed on the stationary base adjacent to the moving label providing a means of range calibration. The laser sight further incorporates an external adjuster module connected co-axially to the cylinder rear face by a pivoting screw. The adjusting module face contains an annular of set screws axially aligned with the cylinder circumference. Alternate screw force applied at the rear cylinder face changes the horizontal and vertical angle of laser beam departure from the bow providing a means for true zero point adjustment. The adjuster module also attaches the laser/stabilizer to the bow stabilizer bushing and provides vertical tracking alignment of the laser beam with respect to the bow. Additionally the laser is activated by a hermetically sealed, magnetically controlled switch and adjustable finger ring magnet combination.

BRIEF DESCRIPTION OF THE DRAWINGS

FIG. 2 is a side view of a hand drawn bow with a laser beam sight and stabilizer of FIG. 1 according to present invention mounted there on;

Figure 1:
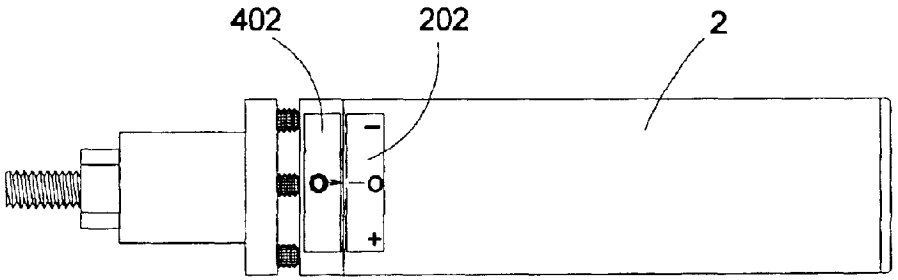
FIG. 1 is the top view of a laser beam sight and stabilizer according to the first embodiment of the present invention and removed from the bow of FIG. 2.

While the invention is susceptible to various modifications and alternative forms, a specific embodiment thereof has been shown by way of example in the drawings and will herein be described in detail. It should be understood however, that the drawings and description thereto are not intended to limit the invention to the particular disclosure, but on the contrary, the intention is to cover all modifications, equivalents and alternatives falling with the spirit and scope of the invention as defined by the appended claims.

DETAILED DESCRIPTION OF THE INVENTION

Figure 2:
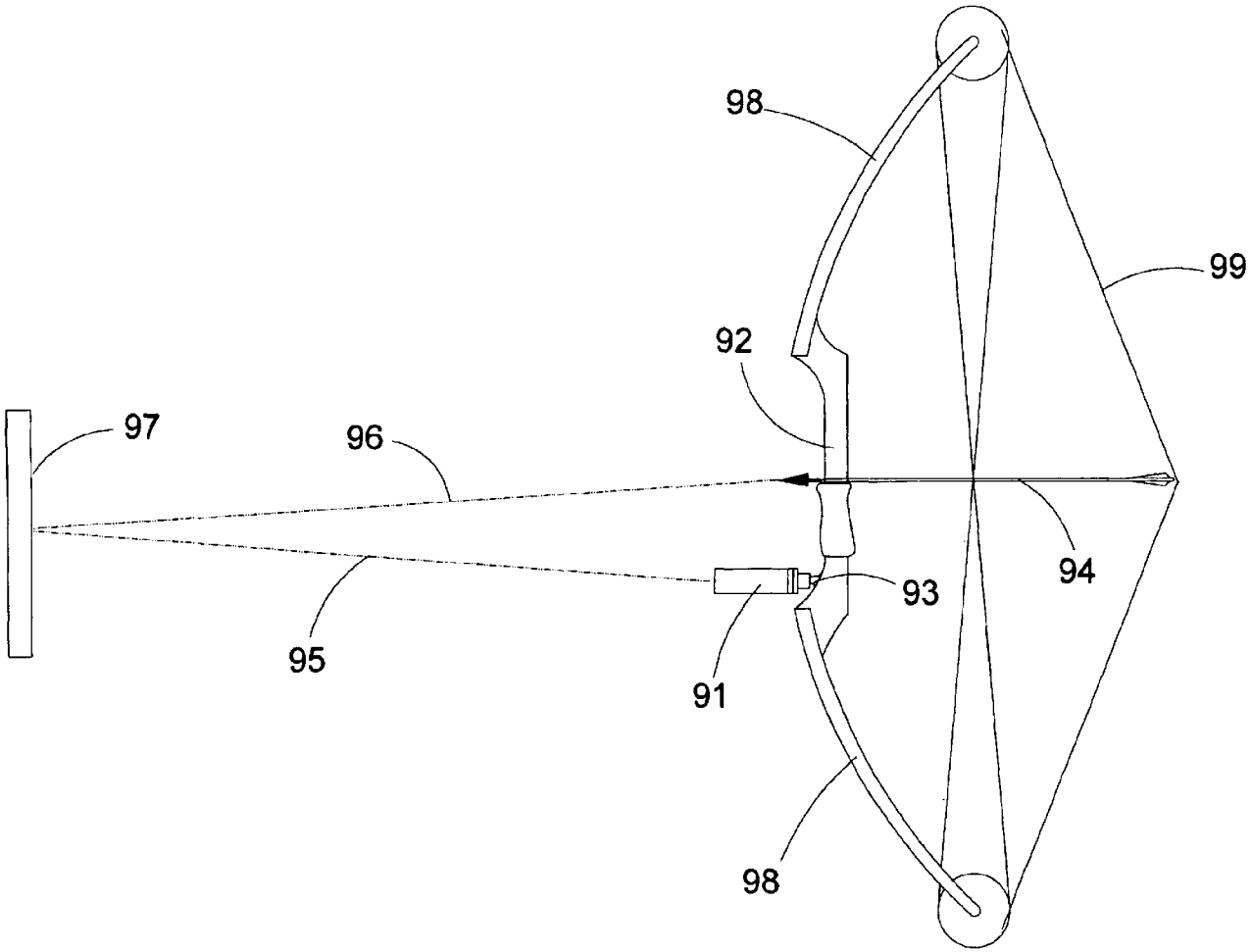
Figure 3:
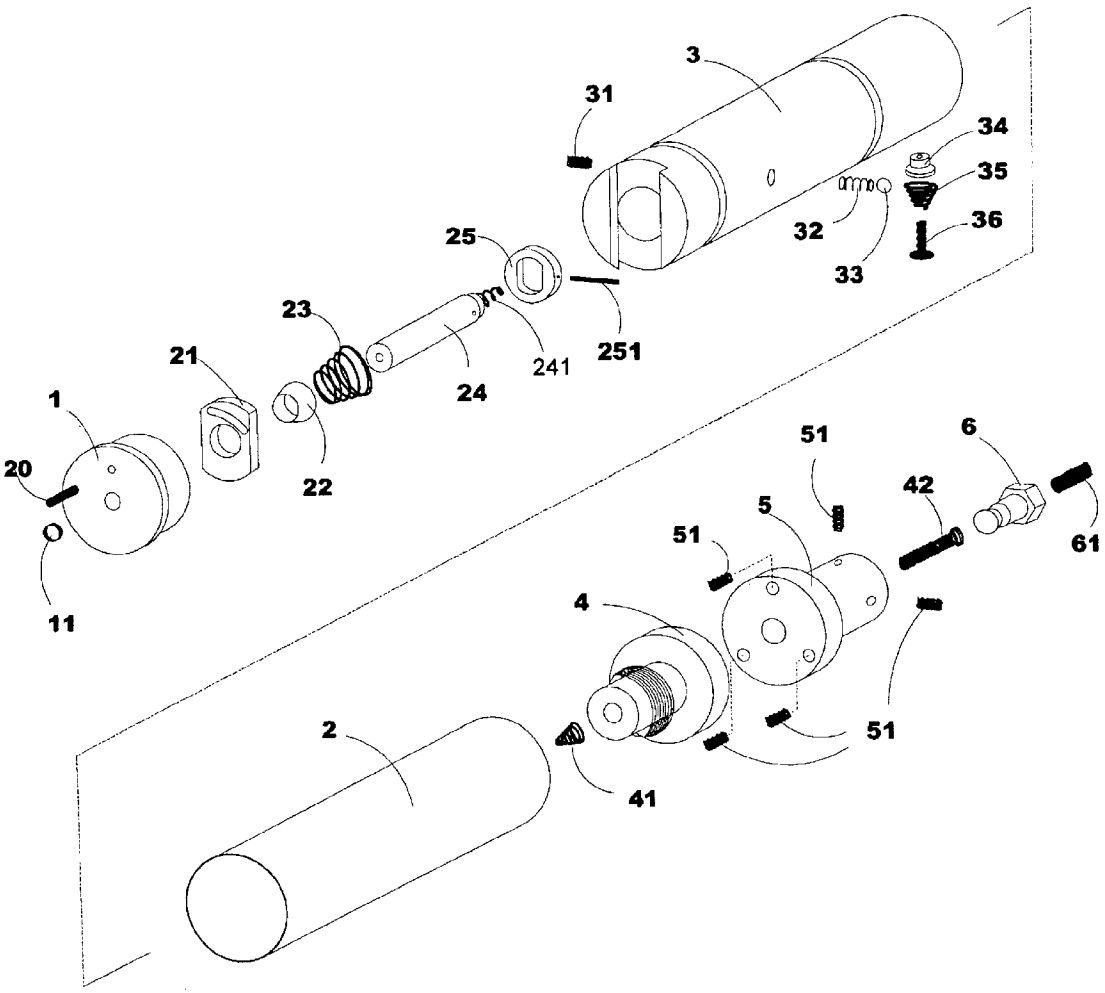
FIG. 3 is an exploded perspective view of a laser sight and stabilizer of FIG. 1 according to one embodiment of the present invention.
Figure 4:
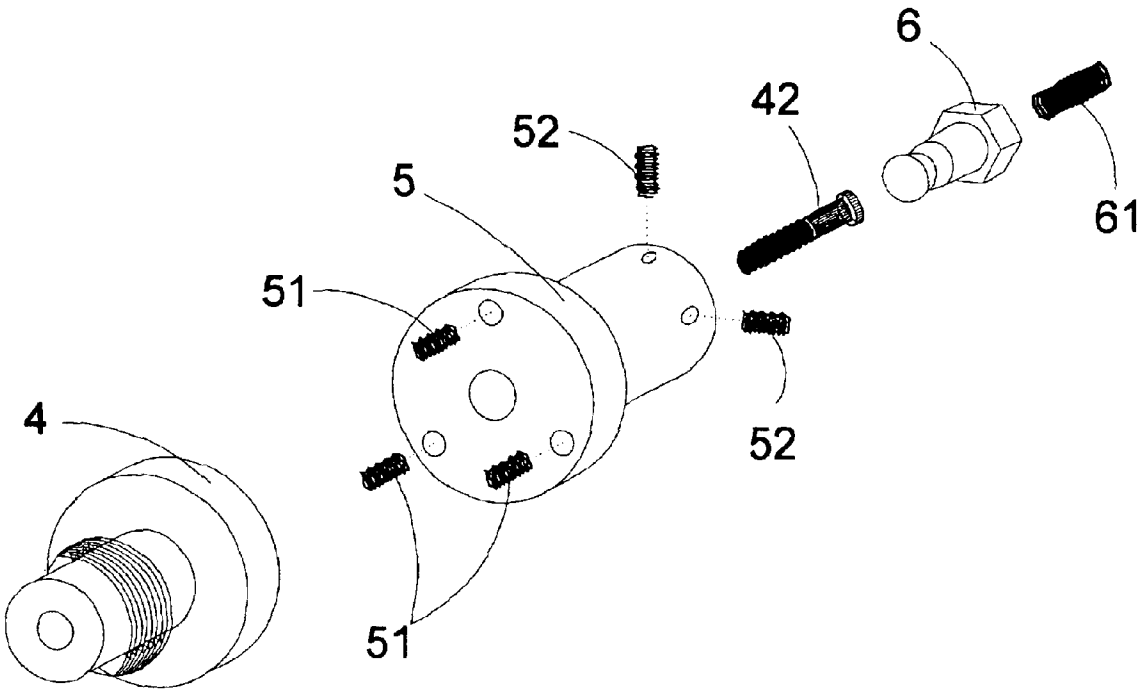
FIG. 4 is a partial exploded perspective view of FIG. 1 indicating the components comprising the zero, vertical orientation and attachment module according to the preferred embodiment of the present invention.

Referring now to the drawings in which like numerals refer to like objects in different views. FIG. 2 is a side view of a conventional hand drawn bow 92 with arrow 94 and light beam sight/stabilizer 91 according to present invention. Laser sight/stabilizer 91 attaches firmly to bow 92 by screwing into stabilizer bushing 93.

When the archer "draws" the bow by applying force to string 99, energy is stored in limbs 98. Upon release of string 99, most of said stored energy is transferred to arrow 94 via string 99 resulting in the forward flight of arrow 94 along trajectory 96. Trajectory 96 is roughly parabolic bending downwardly due to gravity. The curvature of trajectory 96 is shaped by many variables including arrow speed and drag coefficient. As a result, the archer must aim the arrow 94 above the desired target 97 in order for trajectory 96 to intersect the point of aim. The residual energy not imparted to arrow 94 produces vibration and oscillations in all components of bow 92 resulting in unwanted noise and stresses. The present invention guides the archer in correctly elevating and horizontally aligning bow 92 in order to guide arrow 94 to target 97 and absorbs unwanted energy from bow 92.

Concentrated light beam 95 is generated in the preferred embodiment of the present invention by a laser diode, collimating lens, current regulating electronics and a power source. The light beam 95 provides a visual reference of the bows orientation with respect to a given target. The method of horizontal alignment and "zero" setting of beam 95 with respect to trajectory 96 is shown in FIG. 5.

Figure 5:
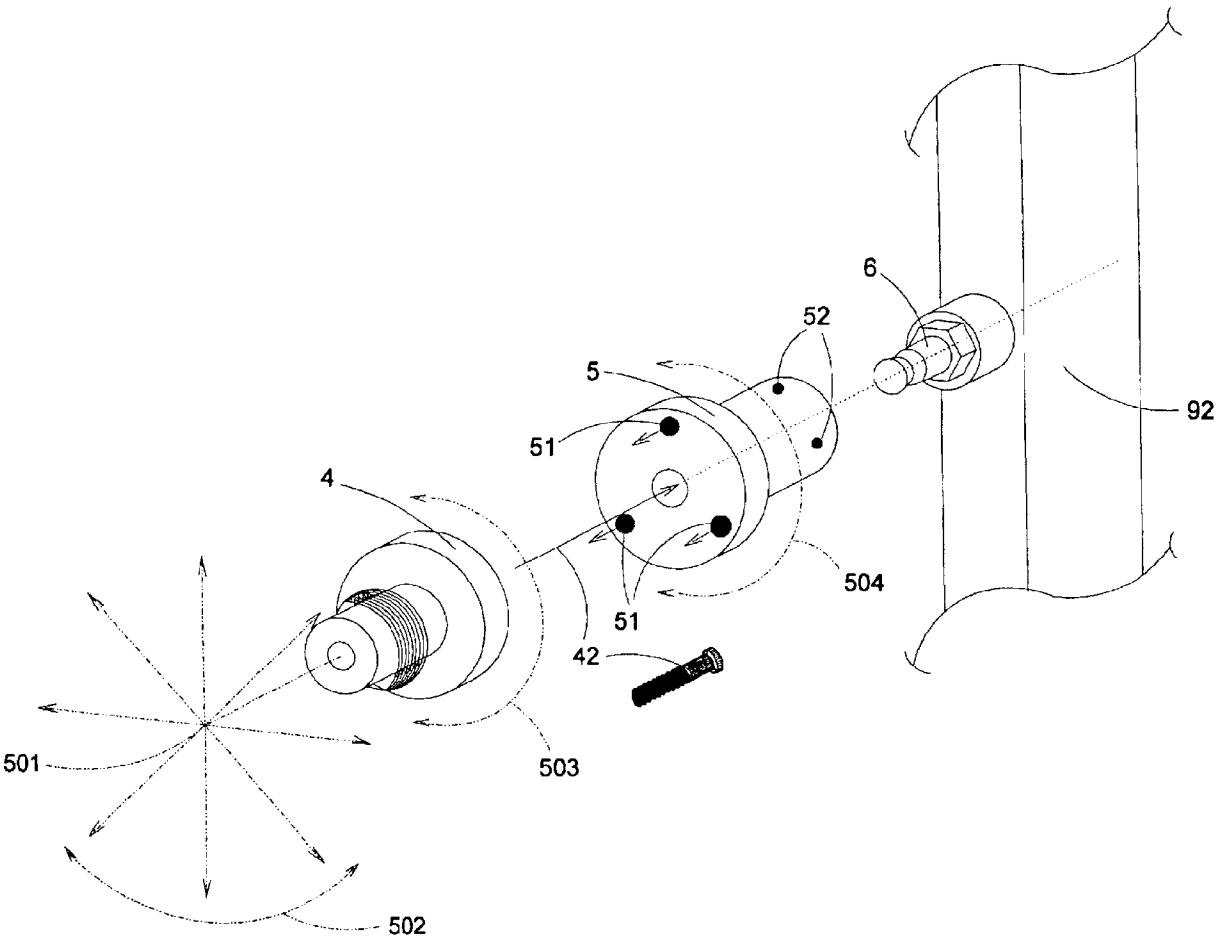
FIG. 5 is a functional diagram of the components of FIG. 4 according to the present invention.

FIG. 5 demonstrates the operation of the adjuster module according to the preferred embodiment of the present invention. The adjusting module 5 face contains an annular of set screws axially aligned with the face of base 4. Base 4 is inserted into body 3 and held firmly in place by screw 36. Base 4 is attached to adjusting module 5 by screw 42. Base 4 is held captive to adjuster 5 by screw 42 but allowed to pivot as represented by vectors 501. By alternately changing the position of set screws 51 and their force acting on base 4, a position change of base 4 occurs as represented by vectors 501. This results in a change of the light beam 95 horizontal and vertical alignment with respect to arrow trajectory 96. This provides a means of the laser sight "zero" calibration and is made at a target distance desired by the archer.

Figure 7A:
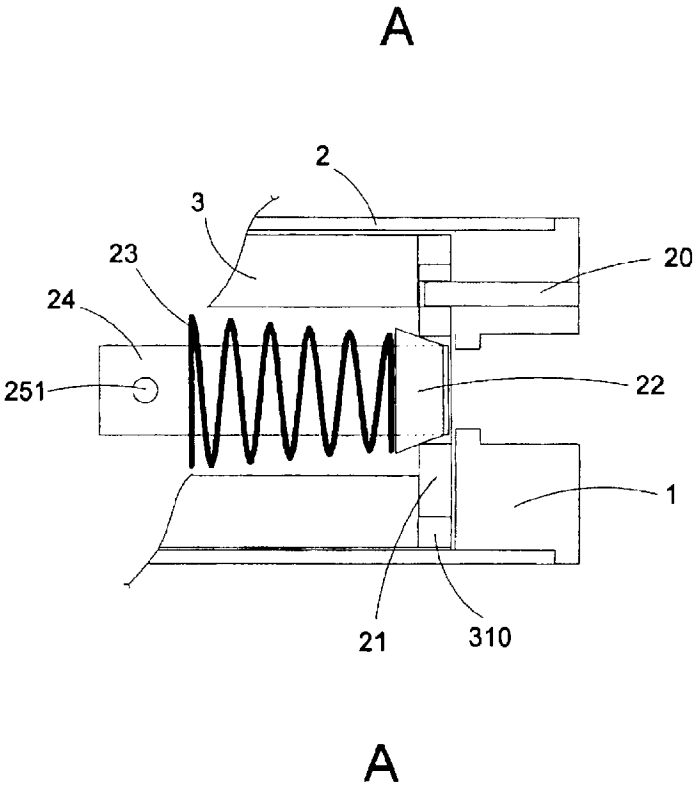
FIG. 7A is a cross section view of FIG. 7 showing additional detail of the range adjustment mechanism according to the present invention.
Figure 7:
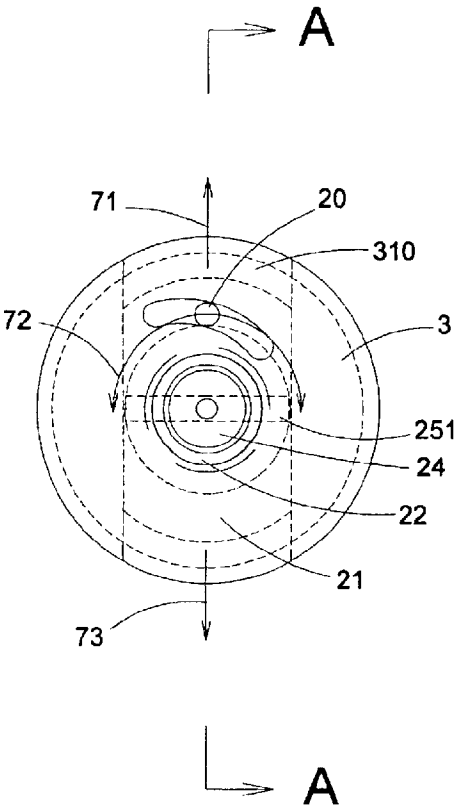
FIG. 7 is a partial front view of FIG. 1 illustrating the range adjustment mechanism according to the present invention.

In archery it is necessary to make relatively large adjustments in bow 92 elevation for changes in target distance to compensate for trajectory 96. FIG. 7 and FIG. 7A demonstrate the range adjustment mechanism according to the preferred embodiment of the present invention. FIG. 7 is a front view illustration of the laser positioning cam 21, cam drive pin 20, inner body 3, tube plug 1, and tube 3. FIG. 7A is a cut away side view of FIG. 7.

Tube 3 and tube plug 1 are joined to for one piece. Cam pin 20 is permanently inserted into plug 1 and protrudes from the rear surface and inserted into the slot of cam 21. The slot of cam 21 is arranged in a non-coaxial manor with respect to the center bore of cam 21 and body 3. Cam 21 is inserted into the it's mating vertical slot of inner body 3 and held captive by tube plug 1, tube 2 and body 3 while being allowed to move perpendicular to the longitudinal axis of body 3. Tube assemble 1, 2 and pin 20 are allowed to rotate axially about body 3 approximately 80 degrees as represented by vector 72. Pin 20 remains in contact with upper and lower surfaces of the slot in cam 21. As pin 20 traverses in an arc aligned co-axially with body 3 as represented by vector 72 force is applied to cam 21 resulting in the linear displacement of cam 21 as represented by vectors 71 and 73.

Laser assembly 24 is inserted into guide ring 25 and joined together by pin 251. Laser 24 and guide ring 25 assembly are inserted into a mating bore of body 3 and held in place by screw 31. Laser assembly 24 is allowed to pivot about pin 251 within guide ring 25 allowing only one axis of travel. Said axis of travel is aligned with the axis of travel of cam 21 along the front face of body 3. The front face of laser 24 is inserted into center bore of and spring 23 and ferrule 22. Ferrule 22 and laser 24 are inserted into the center bore of cam 21. Ferrule 22 is allowed to move freely along the length of laser 24 and held firmly in contact with cam 21 rear bore face as a result of spring 23 compression between ferrule 22 rear face and guide ring 25 front face. Force of spring 23 acting on the rear face of ferrule 23 ensures it's full positive engagement with center bore of cam 21 rear face through the range of travel while maintaining laser 24 center alignment with bore of cam 21.

As a linear position of cam 21 is affected change by a radial position change of pin 20 a resulting angular displacement of laser 24 occurs about pin 251. A resulting angular change of laser beam 95 occurs as a means of range adjustment of the laser sight. A waterproof self-adhesive marking label 202 is attached to the rearward outer surface of tube 2 adjacent to base 4. Another label 402 of same construction in attached to base 4 adjacent to label 202. Reference marks are placed on said labels as a means of trajectory 96 calibration at the archer's discretion.

FIG. 5 illustrates stud 6 is firmly attached to the bow 92 by threaded rod 61. Stud 6 inserts coaxially into the mating bore of adjuster 5 and held firmly in place by screws 52. The adjuster module 5 attaches to and is adjusted axially about stud 6 as represented by vector 504. This provides a means to align the plane of range adjustment parallel with the bow at the archer's discretion.

Figure 6:
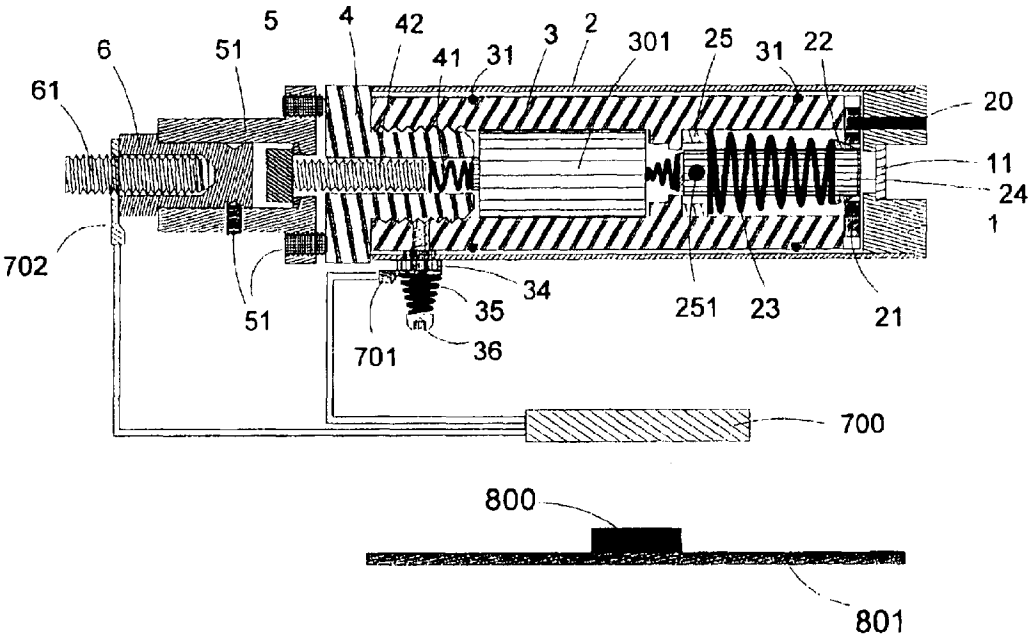
FIG. 6 is a cross-sectional view of the laser sight and stabilizer of FIG. 1 according to the present invention.

FIG. 6 is a cross section view of the first embodiment of the present invention illustrating the external electrical switch, power source and current path for the laser 24. Battery 301 is inserted into body 3 (an electrically insulating material) and making an electrical connection with laser 24 at spring 241. Spring 41 electrically connects battery 301 to screw 42. Screw 42 carries electrical current through (insulator) base 4 to electrical conductors of adjuster 5, stud 6 and screw 61. Switch 700 connects at terminals 702 and 701. Switch 700 is a normally open magnetically operated reed switch as manufactured by Hermetic Switch, Inc. of Chickasha, Okla. or equal. Said switch is further sealed in the interior of a non-magnet cylindrical tube by epoxy cement commonly referred to as electrical potting compound. Switch 700 is attached to bow 92 in a convenient location for the archer. A cylindrical disk type magnet 801 is permanently attached to self-adhering Velcro tape 800 forming a size adjustable magnetic finger ring. When the archer brings the magnetic field in close proximity to the switch the circuit is completed to electrical connector 34. Connector 34 functions to carry electrical current to the moveable tube 2. Electrical current continues through tube 2 to bearing 33 and spring 32 to laser body 24 via pin 251 and guide ring 25 completing the circuit.

Figure 8:
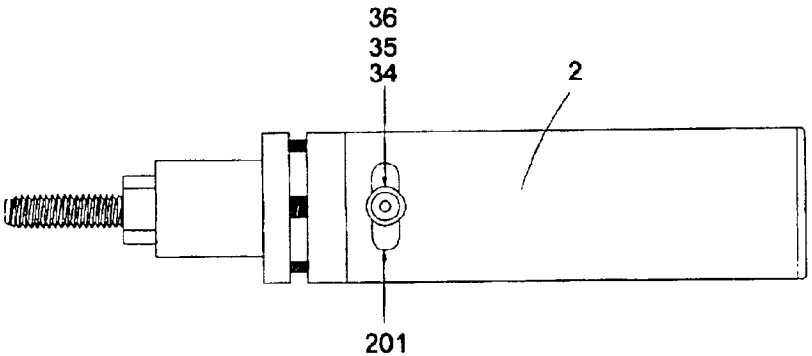
FIG. 8 is a bottom view of FIG. 1 according to the present invention.

FIG. 6 and FIG. 8 further illustrate the function of connector 34, spring 35 and screw 36. Screw 36 compresses spring 35 applying force to the outward face of connector 34. Connector 34 is an electrically conductive material cylindrical in nature with two distinctly different outside diameters and a common axial bore. The smaller O.D. is equal to the width dimension of slot 201 of tube 2 and inserted into same providing a bearing surface to guide the rotation of tube 2 while locking it to body 3. The inner surface of the larger O.D. is held in contact with the outer surface of tube 2 by spring 35 and screw 36. Screw 36 is threaded through body 3 into the first surface of base 4 inserted into body 3.

To facilitate use in all types of weather, the laser sight of present invention provides O-rings 31 that can be installed between body 3 and tube 2. Plug 1, tube 2, pin 20 and acrylic lens 11 join to form a waterproof cover of body 3. Base 4 and screw 42 joined and inserted into body 3 provides a waterproof seal of rear body 3. Thus a means to protect the laser, battery and range positioning mechanism is provided.

The laser sight and stabilizer 91 is connected to bow 92 in a cantilever method at bushing 93 thus providing a means of parasitically absorbing resonate energy from bow 92.

What is claimed is:

1. A integrated adjustable range laser sight and stabilizer for bows, comprising:

a power source;

a laser module consisting of a laser diode, collimating lens and current regulating circuitry assembled within an electrically conductive tube coupled to the power source;

a rotationally adjustable outer housing providing a weatherproof environmental seal protecting the laser assemble, range adjustment mechanism and inner body while providing a light exit window, an electrical current path for the laser module, a means of attachment to the inner body and a calibrated means to adjust vertical inclination of the laser beam with respect to an arrow's trajectory;

a inner non-conductive cylindrical body, a center pivoting screw partially received within said support member between a first, second and third adjusting screws, whereby said support member and attached inner body move about said pivot during rotation of first, second and third adjustment screws;

a external adjuster module, housing said adjusting screws and said pivoting screw while providing a means of radial axial alignment, attachment to an external electrical switch and a bow;

an externally connected, magnetically operated switch and size adjustable finger magnet as a means for controlling laser illumination.

2. The sight of claim 1, wherein the range adjustment system consists of a moving cam having a center bore, parallel guide surfaces and two complementary opposing surfaces creating an arc non-concentric with said bore and substantially perpendicular with it's axis of travel.

3. The sight of claim 2, wherein the laser module front face is inserted into said bore of said cam and center alignment maintained thereof by means of a spring loaded moving member, moving linearly along the outer surface of laser module.

4. The sight of claim 2, wherein the laser module front face is inserted into said bore of said cam and center alignment maintained thereof by means of a spring loaded moving member, moving linearly along the outer surface of laser module.

5. The sight of claim 2, wherein said cam is linearly positioned by means of applied force to opposing complementary surfaces thereof.

6. The sight of claim 5, wherein said applied force is provided by means of mating rotating surfaces, rotating co-axially with respect to the inner body and a member of the outer housing.

7. The sight of claim 6, wherein said rotating outer housing provides a means for attaching a self-adhesive, waterproof range marking label adjacent to the stationary support member.

8. The sight of claim 7, wherein a means is provided for connecting an external electrical switch to the moveable outer housing, provide a bearing surface to limit rotation of and attach said housing to inner body.

9. The laser sight and stabilizer of claim 1, wherein all components previously recited and described in detail herein are incorporated as a means to provide a stabilizer for parasitic absorption of resonate energy from and improve balance of the bow.

* * * * *